United States Patent [19]

McGrath, Jr. et al.

[11] 4,191,294

[45] Mar. 4, 1980

[54] EMPTY CAPSULE EJECTOR

[75] Inventors: James W. McGrath, Jr., Valley Cottage; Paul E. Seifried, New City, both of N.Y.

[73] Assignee: American Cyanamid Company, Stamford, Conn.

[21] Appl. No.: 860,808

[22] Filed: Dec. 15, 1977

[51] Int. Cl.[2] ..... B07B 4/02

[52] U.S. Cl. ..... 209/135; 209/592; 209/644; 209/142

[58] Field of Search ..... 209/74 R, 115, 121, 209/134, 135, 136, 137, 1, 2, 133, 477, 483, 488, 493, 502, 142

[56] References Cited

U.S. PATENT DOCUMENTS

| | | | |
|---|---|---|---|
| 1,003,138 | 9/1911 | Hupner | 209/137 |
| 1,262,559 | 4/1918 | Pritchard | 209/147 |
| 1,356,384 | 10/1920 | Marshall | 209/135 |
| 1,517,595 | 12/1924 | Stebbins | 209/135 |
| 1,792,962 | 2/1931 | Barker | 209/147 |
| 2,405,829 | 8/1946 | Hurley | 209/74 |
| 3,097,161 | 7/1963 | Dudyak | 209/12 |
| 3,612,271 | 10/1971 | Behling | 209/74 |
| 3,941,687 | 3/1976 | Peterson | 209/136 |

*Primary Examiner*—Robert Halper
*Assistant Examiner*—Jon E. Hokanson
*Attorney, Agent, or Firm*—Charles F. Costello, Jr.

[57] ABSTRACT

An apparatus for separating slack-filled capsules from properly filled capsules having the same surface area comprising:

an endless conveyor belt;

means for continuously moving the belt on which is contained at least a single layer of capsules;

an inclined plane at the terminal end of the belt;

a sorting box consisting of a series of fins for orienting the largest cross-sectional area of the capsule profile;

a tunnel whose terminal end is adjacent to the box;

means for creating laminar air flow through the tunnel;

a first tube aligned in about a horizontal position with the tunnel for receiving said slack-filled capsules;

a second tube aligned in about a vertical position with the sorting box such that properly filled capsules enter by gravity;

such that when the laminar air flow is created through the tunnel, the slack-filled capsules enter the first tube.

12 Claims, 3 Drawing Figures

EMPTY CAPSULE EJECTOR

BACKGROUND OF THE INVENTION

This invention relates to an apparatus for separating slack-filled capsules from properly filled capsules having the same surface area.

In manufacturing capsules, particularly capsules for medicinal purposes, it is necessary that each capsule contain the proper amount of material such as medicament. With some capsules such as those containing vitamins which are used over a long period, primarily for preventive rather than for therapeutic purposes, a single slack-filled capsule is not too serious. With capsules containing antibiotics or analgesics and many other therapeutic agents, the contents of a single capsule are relied upon to do a particular job at a particular time, and it is therefore necessary that each capsule contain the desired quantity of medicine.

Any filling operation for the filling of capsules can go wrong, even though highly reliable apparatus and processes are used so that the number of defects is a small fraction. Nonetheless, it is necessary or desirable that the defective capsules, no matter how small their percentage, be selected and rejected. In many instances, the capsules are opaque so that a visual inspection cannot be used. Some other method of eliminating defectively filled capsules is therefore necessary.

Medical capsules are usually either hard shell capsules, in which two pre-formed parts of the capsule are telescoped together to contain the filled material, or soft shell capsules which are formed from strips of soft plastic such as gelatin, with water and plasticizers. The wall thickness are uniform, hence any variation in weight in indicative of an improperly filled capsule. The size of the capsule is usually chosen so that it is impossible to overfill the capsule because it is desired that the maximum contents be placed in the capsule so that the capsule is as small and easily swallowed as possible. The individual weighing of the filled capsules on a sufficiently sensitive scale or balance would give an adequate check; but individual weighing is too expensive and time-consuming to be used in production quantities, if other apparatus and processes can be devised.

The use of machines to separate slack-filled capsules from properly filled capsules have tended to be by weighing the capsules, or by using a sorting device which requires a separate operation during encapsulation. For example, an electronic balance and a centrifuge have been used, respectively, to weigh and to separate capsules.

Applicants are not aware of any prior art reference which, in their respective judgments as one skilled in the apparatus of the instant invention would anticipate or render obvious the apparatus; however, for the purpose of fully developing the background of the invention and establishing the state of the requisite art, the following references are set forth.

U.S. Pat. No. 3,097,161 discloses an apparatus for separating improperly filled capsules by blowing air upwardly through air jets. The capsule profile is moved randomly over the air jets;

And U.S. Pat. Nos. 1,792,962; 1,262,559; and 1,003,138 which disclose generally the use of lateral air flow to separate respectively, oversize materials, and chaff from bean and pea, and from coffee.

The empty capsule ejector of this invention has advantages over the prior art. The empty capsule ejector of this invention can be used online with a continuous encapsulation process. Therefore, the need for additional production for capsule separation is minimized or eliminated. Also, the largest cross-sectional area of the capsule profile is exposed to the laminar air flow of this invention. This results in a more precise control of weight variation, which is of extreme importance where the only variance is capsule weight.

The usefulness of this apparatus for separating slack-filled capsules from properly filled capsules is in the use and control of laminar air flow. The adjustment of the laminar air flow to reduce the turbulence between the point of contact with the capsule profile and the forced air source can be regulated by one or a series of dampers. This adjustment is critical and will vary for capsules with different size and with different medicament powder weight. This apparatus is useful to separate hard shell and soft shell capsules.

SUMMARY OF THE INVENTION

An apparatus has been invented for separating slack-filled capsules from properly filled capsules having the same surface area. The apparatus comprises an endless conveyor belt and means for continuously moving the belt on which is contained at least a single column of capsules.

At the terminal end of the conveyor belt is an inclined plane. A sorting box consisting of a series of fins for orienting the largest cross-sectional area of the capsules is adjacent the terminal end of the inclined plane.

The terminal end of a tunnel is adjacent to the sorting box. Means are provided for creating laminar air flow through the tunnel.

Aligned in about a horizontal position with the tunnel is a first tube for receiving the slack-filled capsules. Aligned in about a vertical position with the tunnel is a second tube such that property filled capsules enter by gravity.

When laminar air flow is created through the tunnel, the slack-filled capsules enter the first tube and the properly filled capsules enter the second tube by gravity.

In one embodiment, the conveyor belt is held taut by roller drums. In another embodiment, the conveyor belt contains at least one track for containing the capsules in at least a single column. In a preferred embodiment, the conveyor belt contains fourteen tracks.

In another embodiment, the inclined plane contains side vanes.

In yet another embodiment, the sorting box contains a series of three fins. In a preferred embodiment, the first and third of the fins are aligned in about a parallel position with the first fin higher than the third fin. The second fin is situated between and is aligned in about a perpendicular position to the first and third fins. In a most preferred embodiment, the second fin is parallel to the inclined plane. In another most preferred embodiment, the third fin contains a horizontal section which is on the opposite side of the tunnel.

In yet another embodiment, the tunnel is rectangular in shape. In a preferred embodiment, the initial end of the first tube is larger than the terminal end of the tunnel.

In still another embodiment, the tunnel contains at least one damper for adjusting the laminar air flow. In a preferred embodiment, at least one damper is located at the terminal end of the tunnel. In a most preferred embodiment, the damper comprises seven vertical and two horizontal dampers.

In a further embodiment an airtight container is attached to the terminal end of the second tube for creating a dead air space and for accumulating the filled capsules.

DESCRIPTION OF THE PREFERRED EMBODIMENT

An apparatus has now been discovered which separates slack-filled capsules from properly filled capsules by the use and control of laminar air flow. The use and control of laminar air flow is critical to this apparatus.

The weight differences between slack-filled capsules and properly filled capsules is very small.

Also, the weight variation between capsules is a factor. For example, the weight variation for hard capsules permitted by the US Pharacopeia in no case exceeds 25%. The apparatus of the invention can separate a slack-filled capsule from a properly filled capsule having this weight variation.

Of critical importance is the profile of the single capsule to the laminar air flow. The capsule profile must be the largest cross-sectional area of the capsule. For example, in many hard shell capsules, the shape is spheroidal. The profile for these capsules must be the longitudinal part. The alignment of the capsule profile to the laminar air flow is not critical.

Figure 1:
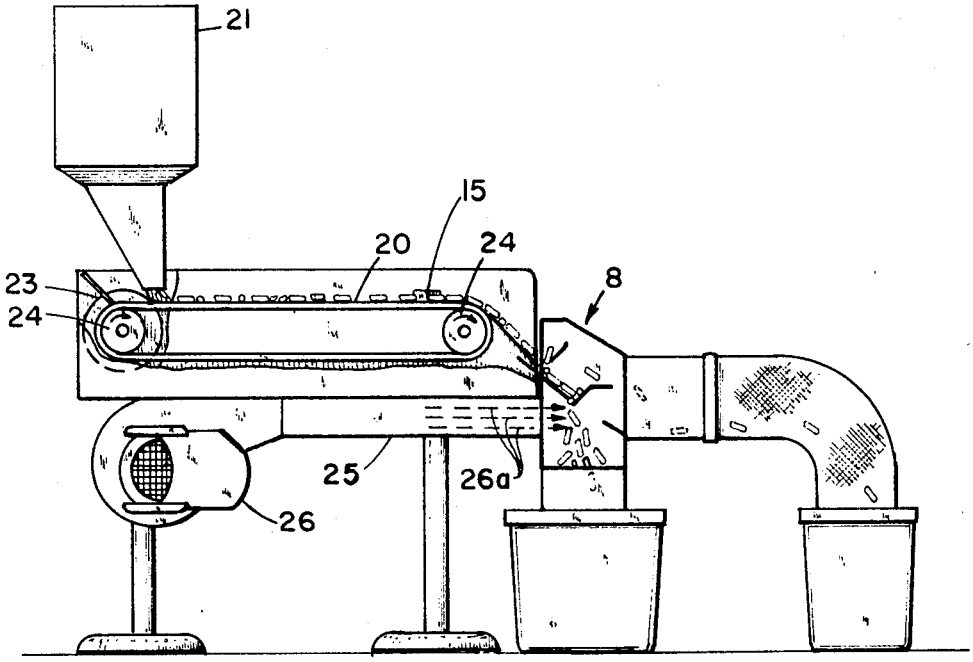
FIG. 1 is a side view of the apparatus.
Figure 3:
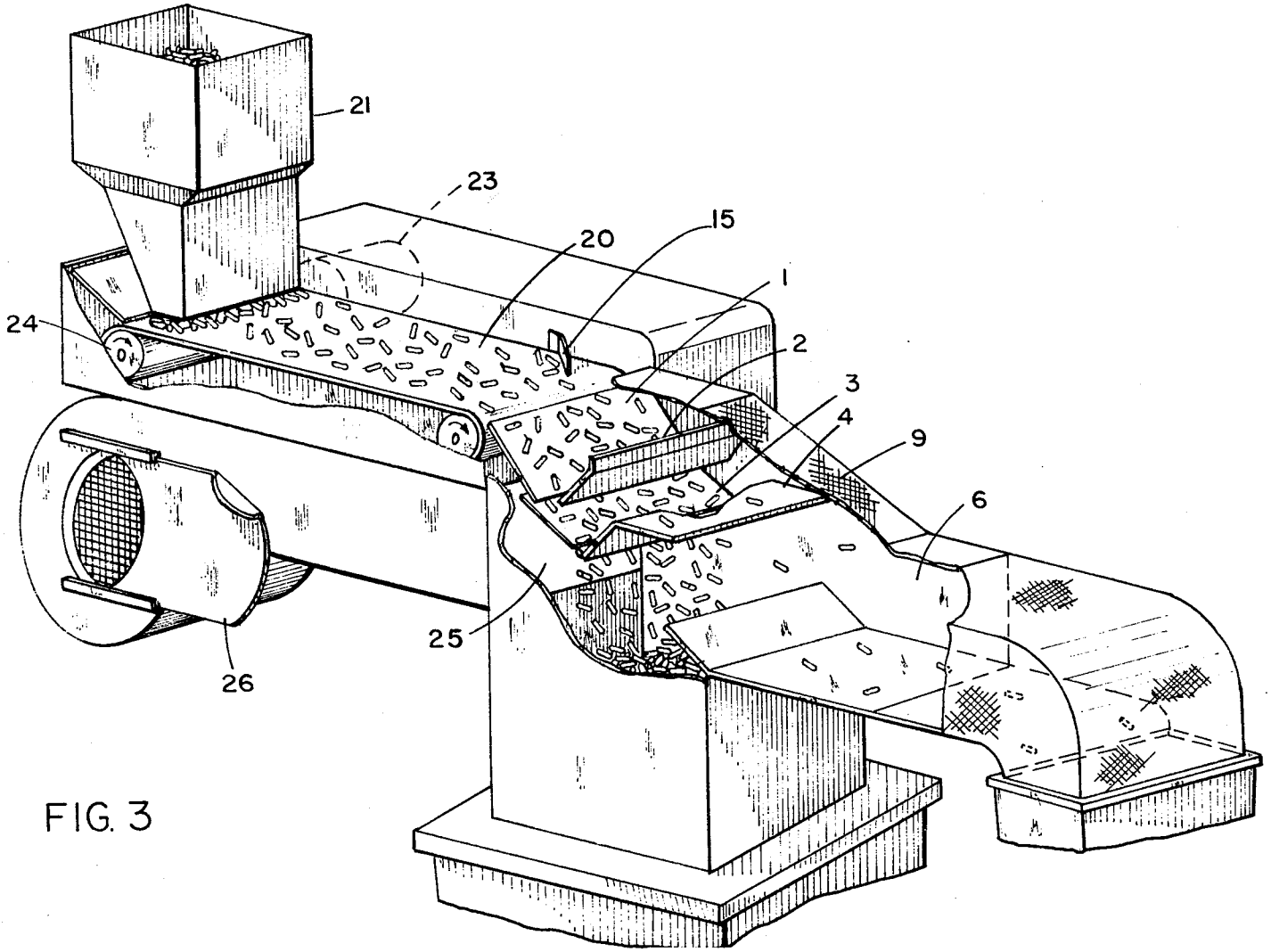
FIG. 3 is a schematic view of FIGS. 1 and 2.
Figure 4:
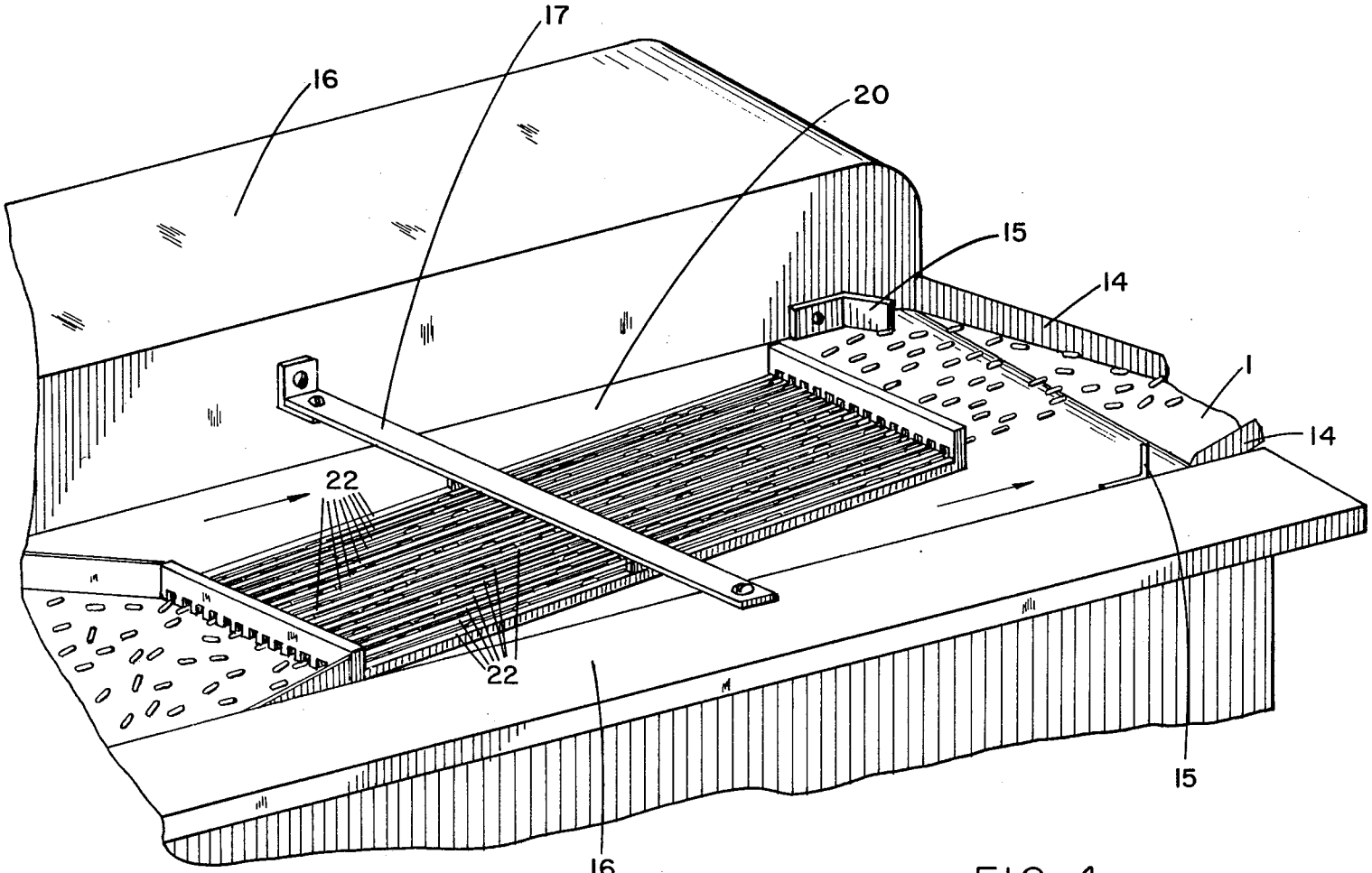
FIGS. 4 and 5 are partial schematic views showing another embodiment of the belt 20 and of the terminal end of the tunnel 25, respectively, of FIG. 3.

Referring to FIGS. 1 and 3, the apparatus consists of an endless conveyor belt 20 supplied by hopper or continuous means 21. A power means 23 continuously moves the conveyor belt. The power means can be, for example, an electric motor. The belt is held taut by roller drums 24 located at the ends of the conveyor belt. Referring to FIG. 4, the belt 20 can contain one or a plurality of tracks 22 for carrying and orienting the capsules. The tracks 22 are contained on the belt 20 by track containing means 17. The containing means 17 is attached to the housing 16. It is to be understood, however, that the tracks comprise an embodiment of the invention but are not necessary to the practice of this invention.

In another embodiment, the inclined plane 1 in FIG. 4 contains side vanes 14, and the belt 20 in FIGS. 1, 3 and 4 contains guide means 15. The side vanes 14 and guide means 15 assist the capsules in leaving the belt and emptying into the sorting box 8 (shown in FIG. 1).

The laminar air flow is generated in the tunnel 25. In the preferred embodiment, the tunnel shape is rectangular. The tunnel size is dependent on the rotational speed of the conveyor belt. A power means 26 creates the laminar air flow **26*a*** through the tunnel. The power means can be, for example, an electrical blower.

Figure 5:
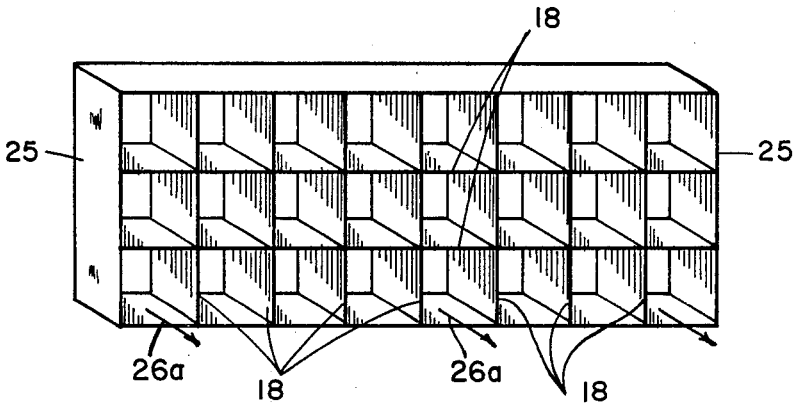

Referring to FIG. 5, another embodiment of the terminal end of the tunnel 25 of FIG. 3 is shown. In a preferred embodiment, at least one damper 18 for adjusting the laminar air flow **26*a* is located at the terminal end. In a most preferred embodiment, seven vertical and two horizontal dampers 18** are located at the terminal end.

The capsules empty into the sorting box 8 located at the end of the conveyor belt. The sorting box is placed in such a position that the capsules will drop by gravity off the belt and into the box.

Figure 2:
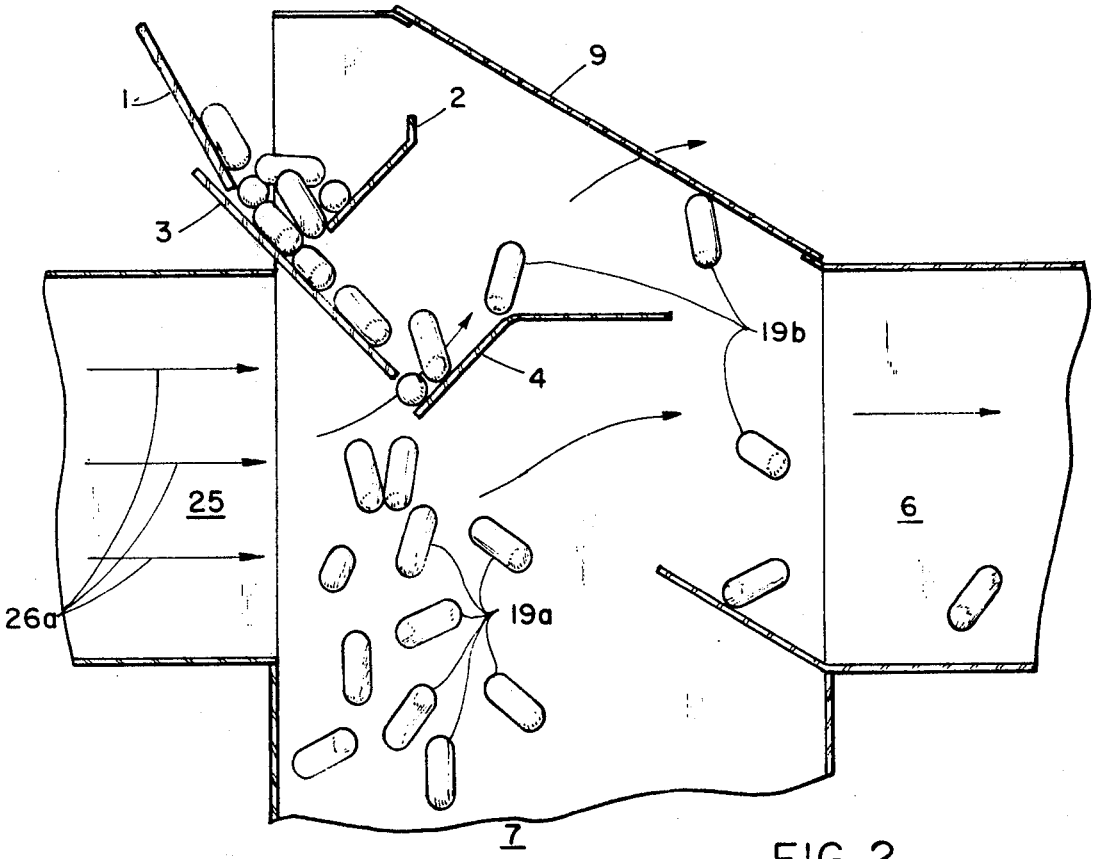
FIG. 2 is a single view of the sorting box.

Referring to FIGS. 2 and 3, in the sorting box are a series of fins 2, 3, and 4. An inclined plane fin 1, outside the box, assists the capsules in leaving the belt.

The angle and separation between the fins 2 and 3 is not critical as long as the capsules speed of motion is reduced without causing the capsules to jam. The angle and separation between fins 3 and 4 is critical and of such a degree and width that only the narrowest part of the capsule will fit through them. This results in the capsule profile to the laminar air flow of a single capsule being the largest cross-sectional area of the capsule.

The capsules leaving the endless belt slide down the inclined plane 1 into the sorting box. The fin 2 keeps the capsules from bouncing up and over the fin.

The capsules then enter and slide down fin 3. The capsules then fall into the slot between fins 3 and 4.

Laminar air **26*a* emerges from the tunnel 25 and impinges on the capsules entering the slot. The laminar air flow is of such a velocity that properly filled capsules 19*a* drop thru the slot and slack-filled capsules 19*b* are lifted up and over the horizontal section of fin 4**.

The laminar air flow separates slack-filled and properly filled capsules by having a straight line flow. The slack-filled capsules **19*b* are lifted up and over the horizontal section of fin 4. Alternatively, the slack-filled capsules 19*b* drop through the slot, pass under fin 4 and are then carried into the first tube 6**.

The laminar air flow imparts no side motion to the capsules. Turbulent air flow would cause the capsules to move sideways and thus touch adjacent capsules.

The slack-filled capsules after passing over the horizontal section of fin 4 pass out the first tube 6 and into a waste bucket. The properly filled capsules **19*a* fall by gravity thru the laminar air stream and into a receiving bucket placed under the sorting box at the second tube 7. The laminar air then exhausts thru a screened section 9 which is adjacent to the initial end of the chute 6**.

It is preferred that the capsules be inspected visually as they come down the conveyor belt to be certain that the colors, sizes and shapes are in conformity with the desired inspection standards. Such inspection may be either continuous or intermittent depending upon the quality of the machines, after the machines are once adjusted and working properly, no additional inspection is required of the individual capsules for considerable periods, and frequently merely a spot inspection by the machine operator is sufficient to insure quality control.

In many instances, with reliable encapsulation machines, slack-filled capsules will be found to exist only when the machine is being first started up, or when bridging occurs in the feed hoppers which feed the contents to the encapsulation machines. If a powder filling is being used, at times the powder can bridge in the feeding device to the encapsulation machine, resulting in a considerable number of slack-filled capsules, or bridging may occur only for one or two capsules in which case only a small number will be rejected.

As will be obvious to those skilled in the art, the machine as described and illustrated may be modified somewhat and remain within the scope of the present invention which is defined by the claims below.

We claim:

1. An apparatus for separating slack-filled capsules from properly filled capsules having the same surface area comprising:

an endless conveyor belt;

means for continuously moving said belt on which is contained at least a single column of said capsules;

an inclined plane at the terminal end of said belt;

a sorting box adjacent the terminal end of said plane consisting of a series of three fins, the first fin higher than the second fin and the second fin higher than the third fin wherein the angle and separation between the first and second fin is such that the speed of motion of said capsules is reduced without jamming and the angle and separation between the second and third fin is such that only the narrowest part of said capsules fit through;

a tunnel whose terminal end is adjacent to said box;

means for creating laminar air flow through said tunnel;

a first tube aligned in about a horizontal position with said tunnel for receiving said slack-filled capsules;

a second tube aligned in about a vertical position with said box such that said properly filled capsules enter by gravity;

said laminar flow being created through said tunnel such that said capsules passing through said second and third fins are oriented to present their largest cross-sectional area to said flow and said slack-filled capsules enter said first tube.

2. The apparatus of claim 1 wherein said belt contains at least one track.

3. The apparatus of claim 2 wherein said belt contains fourteen tracks.

4. The apparatus of claim 1 wherein the first and third of said fins are aligned in about a parallel position and the second fin aligned in about a perpendicular position to said first and third fins.

5. The apparatus of claim 4 wherein said second fin is parallel to said plane.

6. The apparatus of claim 4 wherein said third fin contains a horizontal section extending from the top of said third fin toward said first tube.

7. The apparatus of claim 1 wherein said tunnel is rectangular.

8. The apparatus of claim 7 wherein the initial end of said first tube is larger than the terminal end of said tunnel.

9. The apparatus of claim 7 wherein said tunnel contains at least one damper for adjusting laminar air flow.

10. The apparatus of claim 9 wherein said damper is at the terminal end of said tunnel.

11. The apparatus of claim 10 wherein said damper comprises seven vertical and two horizontal dampers.

12. The apparatus of claim 1 wherein an airtight container is attached to the terminal end of said second tube for creating a dead air space and for accumulating said filled capsules.

* * * * *